United States Patent [19]

Parlato

[11] Patent Number: 4,542,904

[45] Date of Patent: Sep. 24, 1985

[54] POCKET BALL GAME

[76] Inventor: Frank Parlato, 487 Kirkman Ave., Elmont, N.Y. 11003

[21] Appl. No.: 589,749

[22] Filed: Mar. 15, 1984

[51] Int. Cl.[4] ..... A63B 67/14

[52] U.S. Cl. ..... 273/116

[58] Field of Search ..... 273/109–116

[56] References Cited

U.S. PATENT DOCUMENTS

| | | | |
|---|---|---|---|
| 611,086 | 9/1898 | Tickner | 273/115 |
| 1,174,325 | 3/1916 | Kohler | 273/115 |
| 3,787,055 | 1/1974 | Kraemer | 273/113 |

*Primary Examiner*—Richard C. Pinkham
*Assistant Examiner*—Benjamin H. Layno
*Attorney, Agent, or Firm*—Richard L. Miller

[57] ABSTRACT

Ball in pocket, a game of chance and skill provides a player with the opportunity of developing skill at manipulating a playing board on which balls or marbles either land in scoring pockets, are deflected by bumpers or fall into holes or the return slot wherein they are lost from play. The game is fabricated in three layers: a window, a playing board and a bottom board. The window allows easy viewing of the game while retaining all balls and marbles; the play takes place on the playing board; and, the bottom board holds balls or marbles which have fallen through holes or through the return slot. When play has finished, or at any other time, the balls or marbles may be returned to their starting zone by simply turning the game upside down.

5 Claims, 4 Drawing Figures

POCKET BALL GAME

BACKGROUND OF THE INVENTION

The present invention relates to that field of art pertaining to chance-controlled games played on a game board with moveable game pieces.

There are a number of games at the current state of the art which allow a player or players to score points based upon the descent of a ball or balls through a hole or holes. For example, H. J. Robinson (U.S. Pat. No. 3,814,434) provides a board game apparatus in which balls falling through various holes are collected in separate channels for scoring. After the end of the game, in order to recover the balls or marbles, a player would have to turn the entire apparatus upside down in order to have the marbles return through some of the available holes. Not only is this a difficult task, but there is also a likelihood of losing marbles. Also, since the playing board is fully exposed, it is possible to lose marbles during the actual play of the game.

N. H. Sanger (U.S. Pat. No. 2,562,822) provides a chance controlled game apparatus in which the balls or marbles are similarly fully exposed, however, the balls are collected in a drawer. The marbles may be retrieved and replaced into an initiating position, however, there is still a chance of balls being misplaced.

SUMMARY OF THE INVENTION

It is therefore a primary object of the present invention to provide ball in pocket, a game of chance and skill, in which the playing pieces, whether marbles, resilient balls or steel balls, are kept in a sealed system preventing accidental loss or purposeful tampering. This is accomplished by providing a tri-planar arrangement of window, playing board and bottom board in a sandwich configuration so that play may be observed but the balls or marbles remain inaccessible.

A further object is to provide ball in pocket, a game of chance and skill, in which the balls may easily be returned to their initial or starting point. This is accomplished by providing a return slot in the surface of the playing board so that at any desired time the entire game may be turned upside down and simply manipulated to cause the marbles or balls to return to their initial position.

A still further object is to provide ball in pocket, a game of chance and skill which is flexible enough to allow anyone skilled in the art to design an unlimited number of possible games and rules thereof. This is accomplished by providing any number of holes through which balls may exit the active game, pockets for which incident balls are scored and bumpers off which balls may be deflected.

A yet further object is to provide ball in pocket, a game of chance and skill, which is simple in construction and inexpensive to fabricate. The instant invention may be constructed of wood in a common wood shop or may be molded out of plastic. Possible window materials include glass and acrylics. Possible playing board materials include wood, composition board, sheet metal and plastics.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
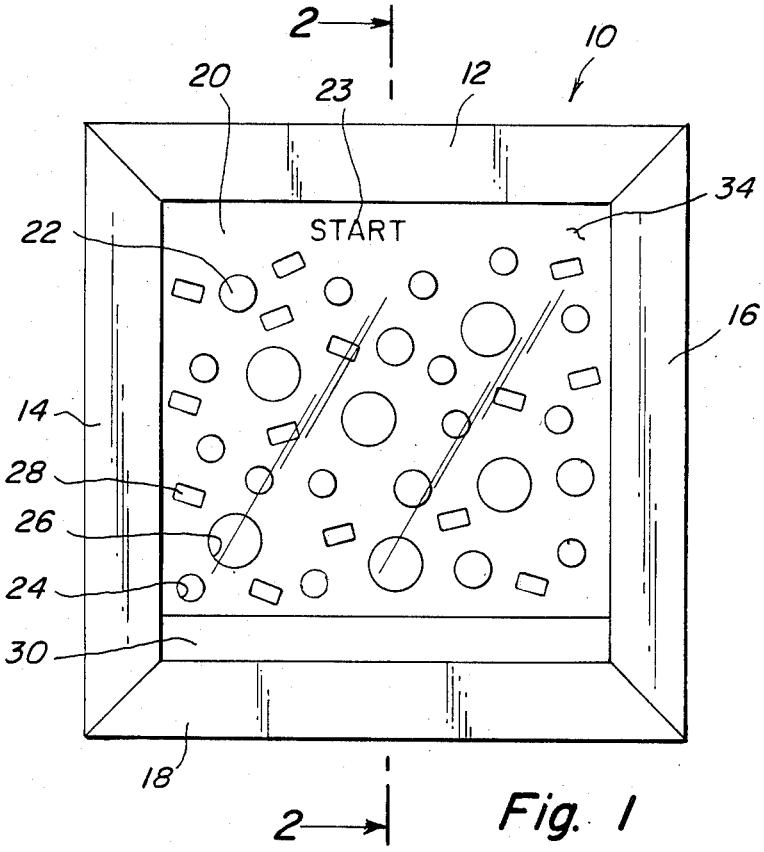
FIG. 1 is a plan view of the top of the invention.
Figure 4:
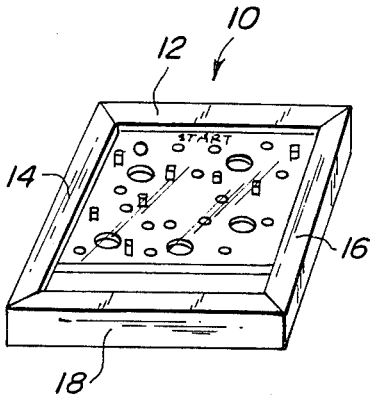
FIG. 4 is a perspective view of the invention.

The overall construction of ball in pocket, a game of chance and skill, may best be understood by reference to FIG. 1. The invention 10 basically consists of a frame, two boards and a window. The frame is constructed in four sections: a top member 12, a left member 14, a right member 16 and a bottom member 18. A transparent window 34, which cannot be seen in this view, covers playing board 20. Any ball, typified by ball 22, once it has left starting zone 23, may be incident upon four distinct types of targets: a pocket, typified by pocket 24; a hole, typified by hole 26; a bumper, typified by number 28; or, the return slot 30.

Figure 2:
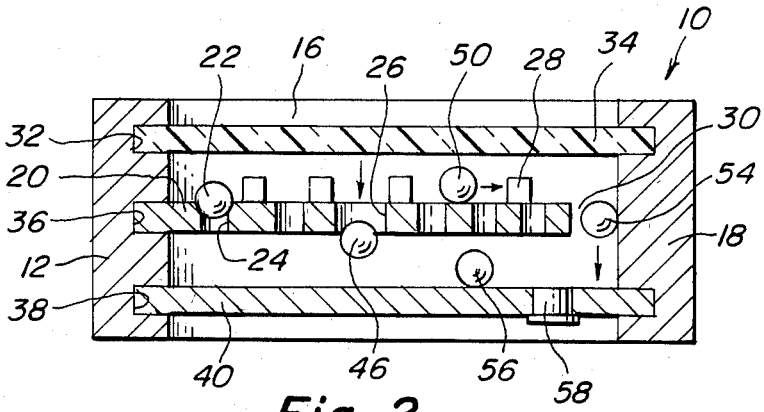
FIG. 2 is a cross sectional view of the invention taken on line 2—2 of FIG. 1.
Figure 3:
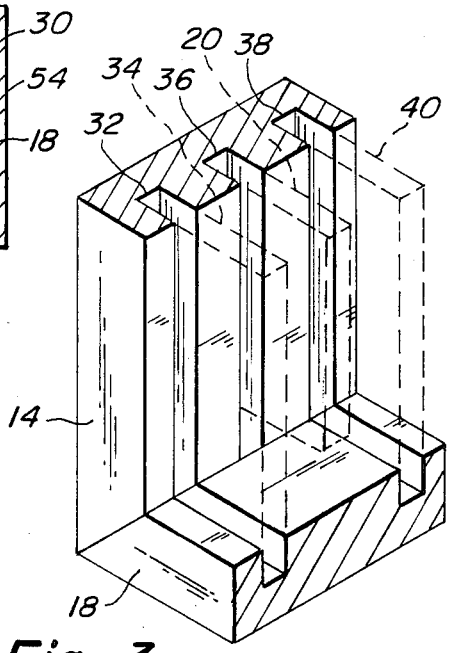
FIG. 3 is a broken away perspective view of a corner thereof.

The manner in which these targets behave may best be understood by reference to FIG. 2. Window channel 32 supports window 34; playing board channel 36 supports playing board 20; and, bottom board channel 38 supports bottom board 40. Window 34 may be made of glass, acrylic or any transparent sheet material. Playing board 20 and bottom board 40 are typically made of composition board although wood, metal or plastic may be used.

When a ball, such as that typified by 22, is incident upon a pocket, such as that typified by 24, the ball 22 remains temporarily in the pocket 24 since the diameter of pocket 24 is less than the diameter of the ball 22.

When a ball, such as that typified by 46, is incident upon a hole, such as that typified by 26, the ball 46 will fall through the hole 26 and come to rest upon bottom board 40, since the diameter of hole 26 is larger than the diameter of ball 46.

If a ball, such as that typified by 50, is incident upon a bumper, such as that typified by 28 the impact of the ball will cause the ball to be deflected in its path.

If a ball, such as that typified by 54, is incident upon the return slot 30, the ball 54 will come to rest upon the bottom board 40. Typical ball 56 has already come to rest upon bottom board 40. In order to recover the balls which have come to rest upon bottom board 40 the invention 10 is turned upside down and the balls will fall through return slot 30 back to the playing side of the playing board 20. By simple manipulation the balls can be returned to starting zone 23.

When the invention 10 is first set up, or at any time thereafter, access to the balls may be contained by removing plug 58. Once plug 58 has been removed balls may be either added or taken away.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Ball in pocket, a game of chance and skill, comprising in combination:

(a) a frame containing a left hand member, a right hand member, a top member and a bottom member;

(b) at least one ball;

(c) a window, mounted on said frame, such that objects below said window may be clearly seen;

(d) a playing board, lying in a plane parallel to and beneath said window, whereby a ball game may be played upon said playing board and viewed through the window;

(e) a bottom board, lying in a plane parallel to and beneath said playing board whereby any of said balls exiting said playing board come to rest upon said bottom board;

(f) means for adding and removing said balls from said game; and, (g) means for easily restoring said balls to an original starting position, said left hand member, said right hand member and said top member of said frame each having three parallel channels such that said frame forms three sets of contiguous channels each defining three separate parallel planes wherein sets of contiguous said channels firmly and fixedly mount said window, said playing board and said bottom board, on said three separate parallel planes in said frame and wherein said bottom member of said frame has only two channels which are contiguous with said channels for mounting said window and said bottom board, said playing board being shorter than said window and said bottom board, whereby its edge is spaced from said bottom member so as to define therewith a channel along the entire length of said bottom member, said channel serving as said means for easily restoring said balls to an original starting position, whereby at any time any of said balls which have come to rest on said bottom board may be returned to an initial starting position on said playing board by turning said game upside down.

2. Ball in pocket, a game of chance and skill, as recited in claim 1, wherein said playing board contains a multiplicity of holes of such dimension as to allow a ball incident upon said holes to drop through said holes and come to rest upon said bottom board.

3. Ball in pocket, a game of chance and skill, as recited in claim 1, wherein said playing board contains a multiplicity of pockets comprising holes on the surface of said playing board, wherein said holes are of such dimension as to allow a ball incident upon said pocket to remain temporarily fixed in position on the playing board until said game is moved.

4. Ball in pocket, a game of chance and skill, as recited in claim 1, wherein said playing board contains a multiplicity of bumpers which change the course of any of said balls incident upon the surface of said bumpers.

5. Ball in pocket, a game of chance and skill, as recited in claim 1, wherein said means for adding and removing said balls from said game comprise a removable plug located on the surface of said bottom board.

* * * * *